US007882655B1

(12) United States Patent
Nesseth et al.

(10) Patent No.: US 7,882,655 B1
(45) Date of Patent: Feb. 8, 2011

(54) REAR GUN SIGHT DEVICE FOR AK47 OR SIMILAR RIFLE

(76) Inventors: Lawrence Arden Nesseth, 2242 18 3/4 Ave., Rice Lake, WI (US) 54868; Erik Lawrence Nesseth, 15090 Tall Pines Dr., Atlantic Mine, MI (US) 49905

( * ) Notice: Subject to any disclaimer, the term of this patent is extended or adjusted under 35 U.S.C. 154(b) by 266 days.

(21) Appl. No.: 12/284,006

(22) Filed: Sep. 17, 2008

(51) Int. Cl.
*F41G 1/38* (2006.01)

(52) U.S. Cl. ..... 42/124; 42/111; 42/140; 89/41.17

(58) Field of Classification Search ..... 42/111, 42/113, 124, 140, 148, 138; 89/192, 41.17, 89/41.19
See application file for complete search history.

(56) References Cited

U.S. PATENT DOCUMENTS 7,076,907 B2 * 7/2006 Nesseth et al. ..... 42/140
2006/0005450 A1 * 1/2006 Nesseth et al. ..... 42/140

OTHER PUBLICATIONS

Israel Military Industries, Galil 5.56mm, Assault Rifle Operator's Manual, Appendix B.

* cited by examiner

*Primary Examiner*—Michael Carone
*Assistant Examiner*—Jonathan C Weber

(57) ABSTRACT

A rear gun sight device for a rifle having a receiver and cover, the receiver having a tee shaped slot on the top rear of the receiver. This slot is designed to accept and retain a recoil assembly. The invention replaces the rear portion of the recoil assembly allowing the invention to perform the function of the original rear portion of the recoil assembly as well as provide a rear sight for the rifle. This invention is comprised of a sight base provided with a tee shaped base to engage the tee shaped slot in the top rear trunion of the rifle's receiver, a spring boss to accept the end of the recoil spring when assembled in the recoil assembly, a spring guide to guide the recoil spring, a sight component assembly comprised of windage and elevation adjustment components as well as aperture sight components, and cover retention elements.

13 Claims, 8 Drawing Sheets

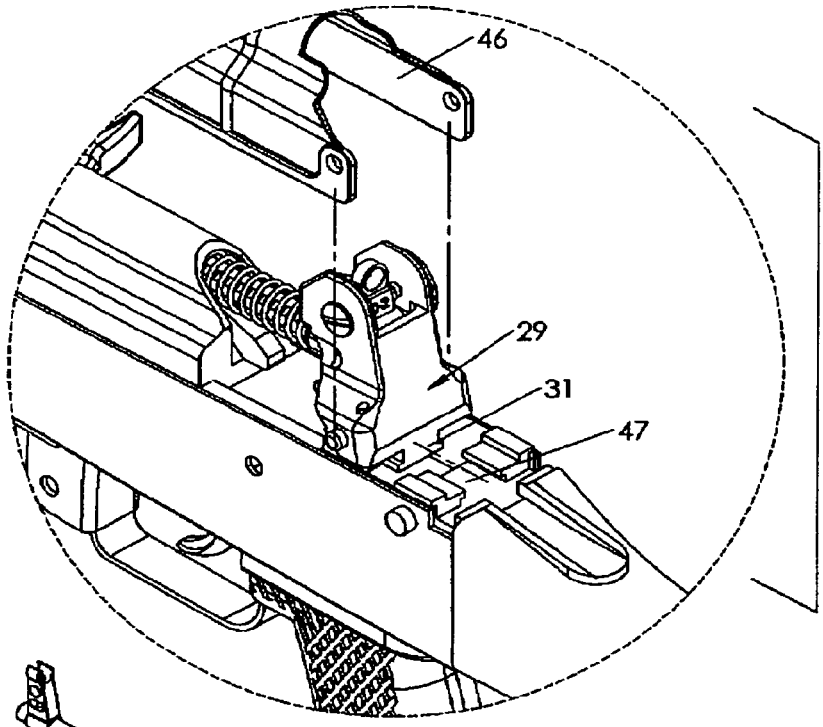
FIG 3
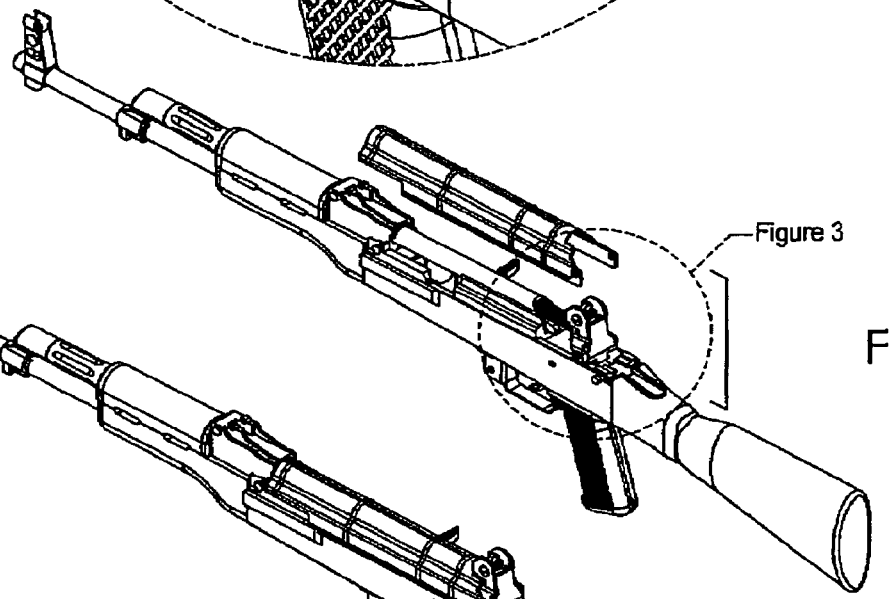
FIG 2
FIG 1

REAR GUN SIGHT DEVICE FOR AK47 OR SIMILAR RIFLE

CROSS REFERENCE TO RELATED APPLICATIONS

Not applicable.

STATEMENT REGARDING FEDERALLY SPONSORED RESEARCH OR DEVELOPMENT

Not Applicable

DESCRIPTION OF ATTACHED APPENDIX

Not Applicable

FIELD OF THE INVENTION

This invention relates generally to the field of rear guns sight devices for rifles and more specifically to a rear gun sight device for a rifle having a receiver and cover, the receiver having a tee shaped slot on the top rear of the receiver.

BACKGROUND OF THE INVENTION

The AK47 rifle in its original configuration is equipped with a tangent notch sight mounted just forward of the rifles receiver approximately 10" from the shooters eye. This results in a very short sight radius. Any misalignment of the front and rear sights using the short sight radius provided on the AK47 in it's original configuration results in large inaccuracies when engaging the intended target. One method of increasing the sight radius on a AK47 type rifle was employed by Israel Military Industries in Producing the Galil, a variant of the AK47 design adapted for the Israeli Military. The method was to use the receiver cover to mount a sight component assembly. This increased the sight radius, but was mounted to the receiver cover which is unstable for precision mounting a rear sight.

BRIEF SUMMARY OF INVENTION

This invention relates generally to the field of rear guns sight devices for rifles and more specifically to a rear gun sight device for a rifle having a receiver and cover, the receiver having a tee shaped slot on the top rear of the receiver. This slot is designed to accept and retain a recoil assembly. The invention replaces the rear portion of the recoil assembly. This allows the invention to perform the function of the original rear portion of the recoil assembly as well as provide a rear sight for the rifle. The novel rear gun sight device is especially adapted to the AK47 or similar type rifle. This rear gun sight device includes a sight base with a tee shaped base that engages the tee shaped slot in the rear portion of the AK47 receiver providing a stable base for the sight assembly to mount. By integrating the rear gun sight device into the recoil system of the AK47 rifle the rear gun sight device is able to utilize this tee shaped slot without restricting the function of the AK47's operating system. This invention provides the AK47 with an improved sight by increasing the sight radius by approximately eight inches. The original AK47 sight is of a tangent type and is mounted on the barrel ahead of the receiver, resulting in a very short sight radius. The shorter sight radius provided for in the original design of the rifle is more likely to cause human error when aligning sights to engage a target.

In accordance with a preferred embodiment of the invention, there is disclosed a rear gun sight device for a rifle having a receiver and cover, the receiver having a tee shaped slot on the top rear of the receiver. This slot is designed to accept and retain a recoil assembly. The invention replaces the rear portion of the recoil assembly. This allows the invention to perform the function of the original rear portion of the recoil assembly as well as provide a rear sight for the rifle. The rear gun sight device is comprised of a sight base with an integrated tee shaped base to engage the tee shaped slot in the top rear trunion of the rifle's receiver, a spring boss to accept the end of the recoil spring when assembled in the recoil assembly, a spring guide to guide the recoil spring, cover retention elements and sight component assembly comprised of windage and elevation adjustment components as well as sight elements attached directly to the sight base.

In accordance with a preferred embodiment of the invention, there is disclosed a rear gun sight device for a rifle having a receiver and cover, the receiver having a tee shaped slot on the top rear of the receiver. This slot is designed to accept and retain a recoil assembly. The invention replaces the rear portion of the recoil assembly. This allows the invention to perform the function of the original rear portion of the recoil assembly as well as provide a rear sight for the rifle. The rear gun sight device is comprised of a sight base with an integrated tee shaped base to engage the tee shaped slot in the top rear trunion of the rifle's receiver, a spring boss to accept the end of the recoil spring when assembled in the recoil assembly, a spring guide to guide the recoil spring, cover retention elements and sight component subassembly comprised of windage and elevation adjustment components as well as sight elements. This sight component subassembly is attached to the sight base by various means such as but not limited to screws, clamping or friction.

OBJECTS OF THE INVENTION

The primary object of the invention is provide an improved rear sight for the AK47 rifle or similar rifle.

Another object of the invention is to increase AK47 rifle's sight radius by approximately eight inches over the original tangent sight.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 1 is a perspective view of an AK47 or similar rifle incorporating the novel gun sight device.

FIG. 2 is an exploded perspective view of an AK47 or similar rifle incorporating the novel gun sight device, showing detail area for FIG. 3.

FIG. 3 is an exploded and enlarged detail view of the sight device installed on an AK47 or similar rifle.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 6:
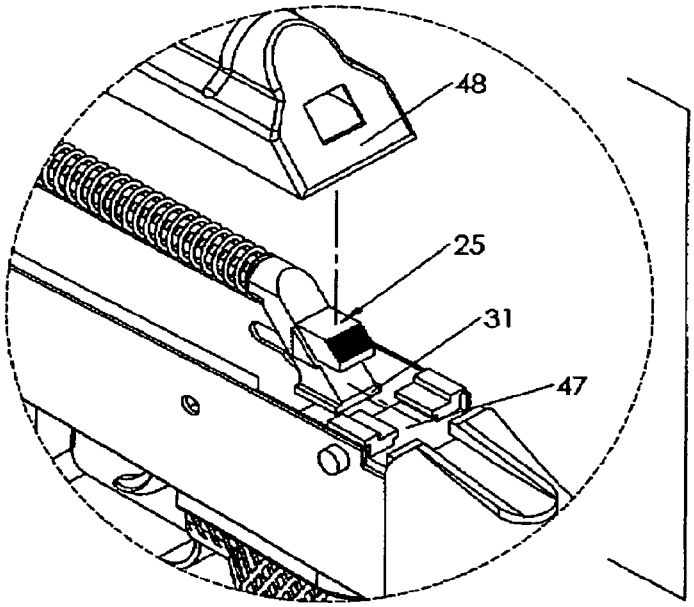
FIG 6 (Prior Art)
FIG. 6 is an exploded and enlarged detail view of the AK47 or similar rifle in its original configuration prior to incorporating the novel gun sight device.
Figure 5:
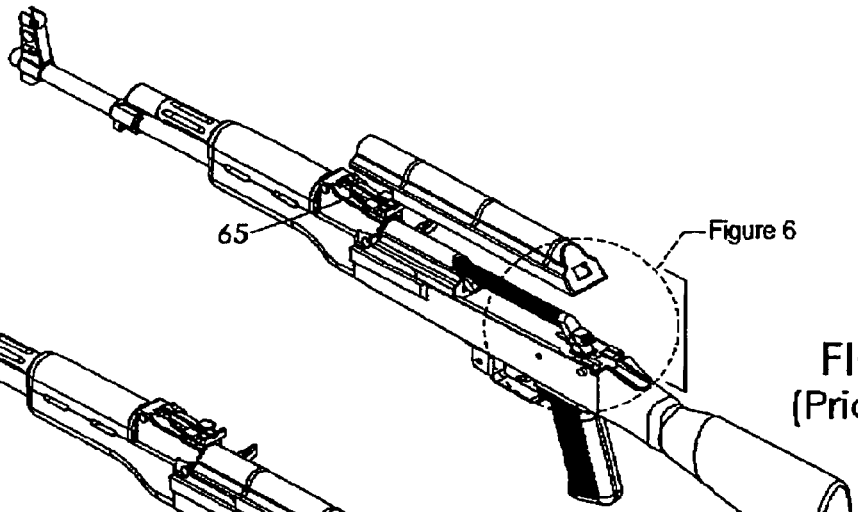
FIG 5 (Prior Art)
FIG. 5 is an exploded perspective view of an AK47 or similar rifle in its original configuration prior to incorporating the novel gun sight device showing the detail area for FIG. 6.
Figure 4:
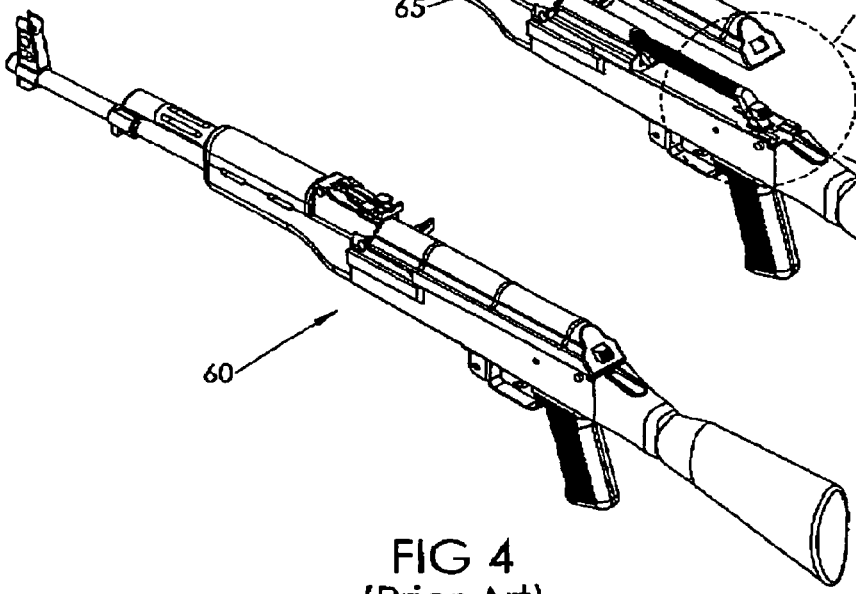
FIG 4 (Prior Art)
FIG. 4 is a perspective view of an AK47 or similar rifle in its original configuration prior to incorporating the novel gun sight device.
Figure 7:
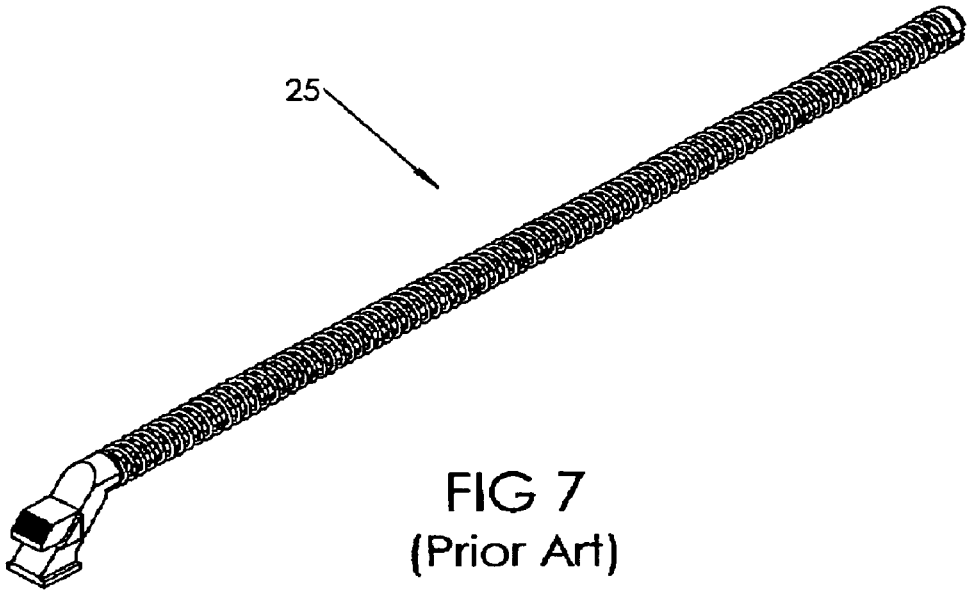
FIG 7 (Prior Art)
FIG. 7 is a perspective view showing the original AK47 or similar rifle recoil assembly assembled, prior to incorporating the novel gun sight device.
Figure 8:
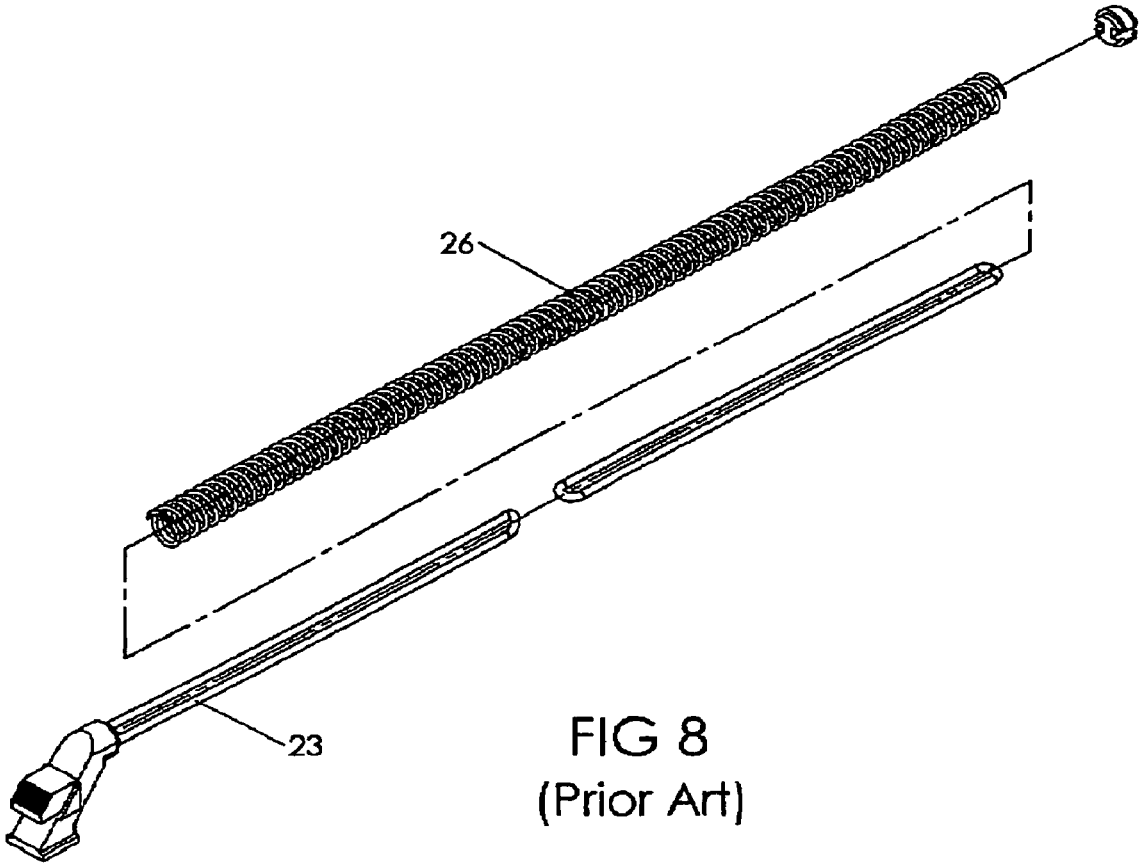
FIG 8 (Prior Art)
FIG. 8 is an exploded perspective view showing the original AK47 or similar rifle recoil assembly prior to incorporating the novel gun sight device.
Figure 9:
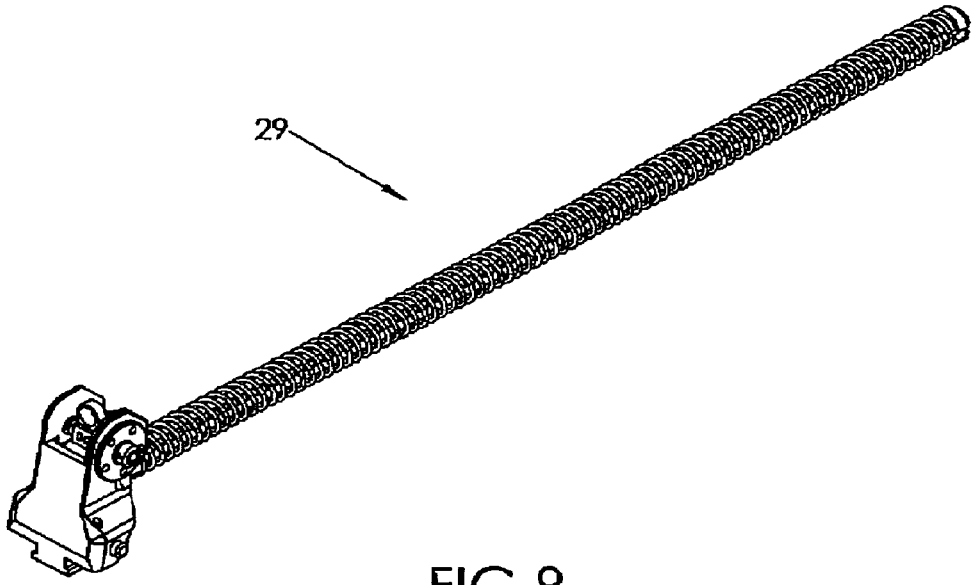
FIG. 9 is a perspective view showing an AK47 or similar rifle recoil assembly assembled, incorporating the novel gun sight device.
Figure 10:
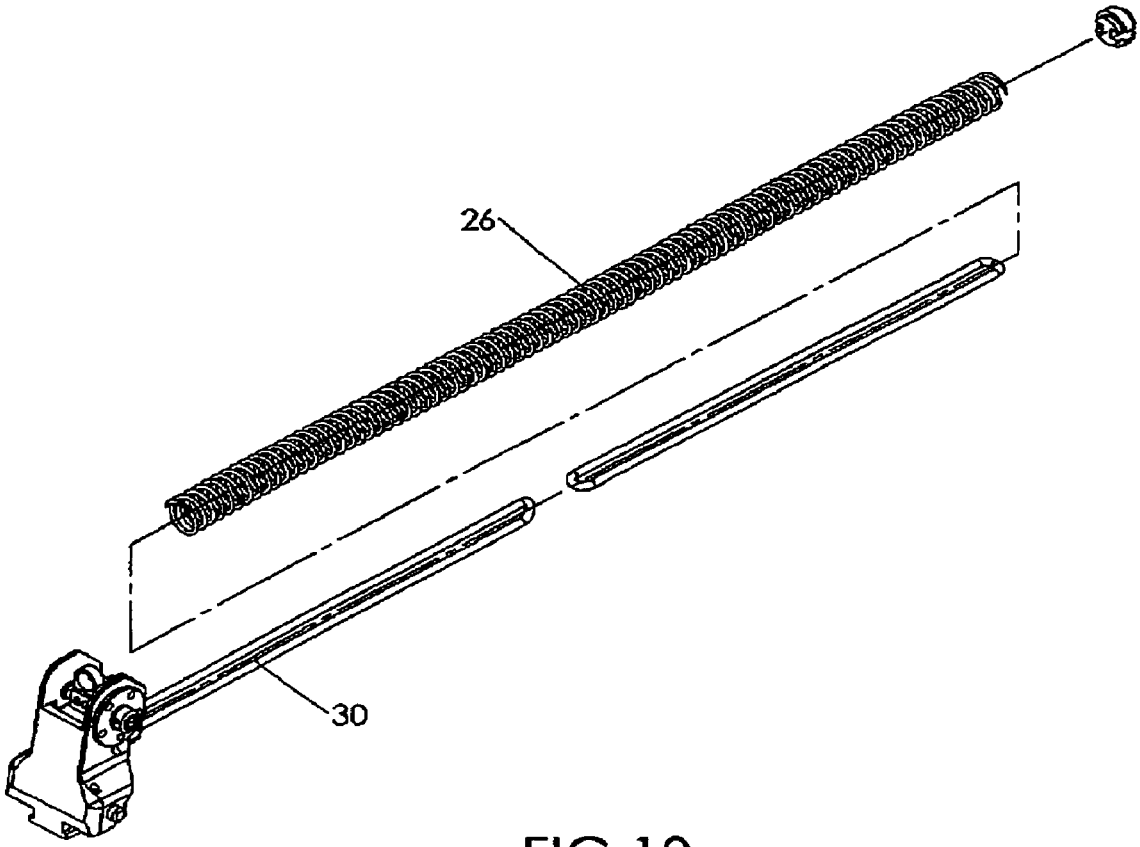
FIG. 10 is an exploded view showing an AK47 or similar rifle recoil assembly incorporating the novel gun sight device.
Figure 11:
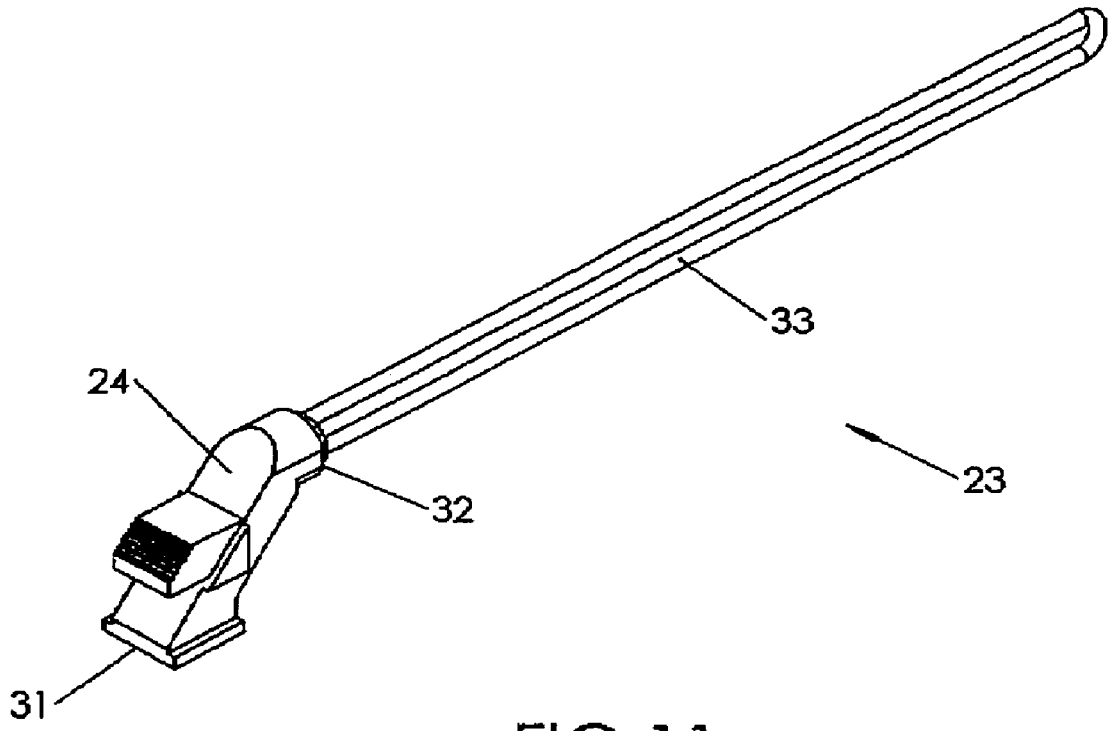
FIG 11 (Prior Art)
FIG. 11 is a perspective view showing the original AK47 or similar rifle guide rod.
Figure 12:
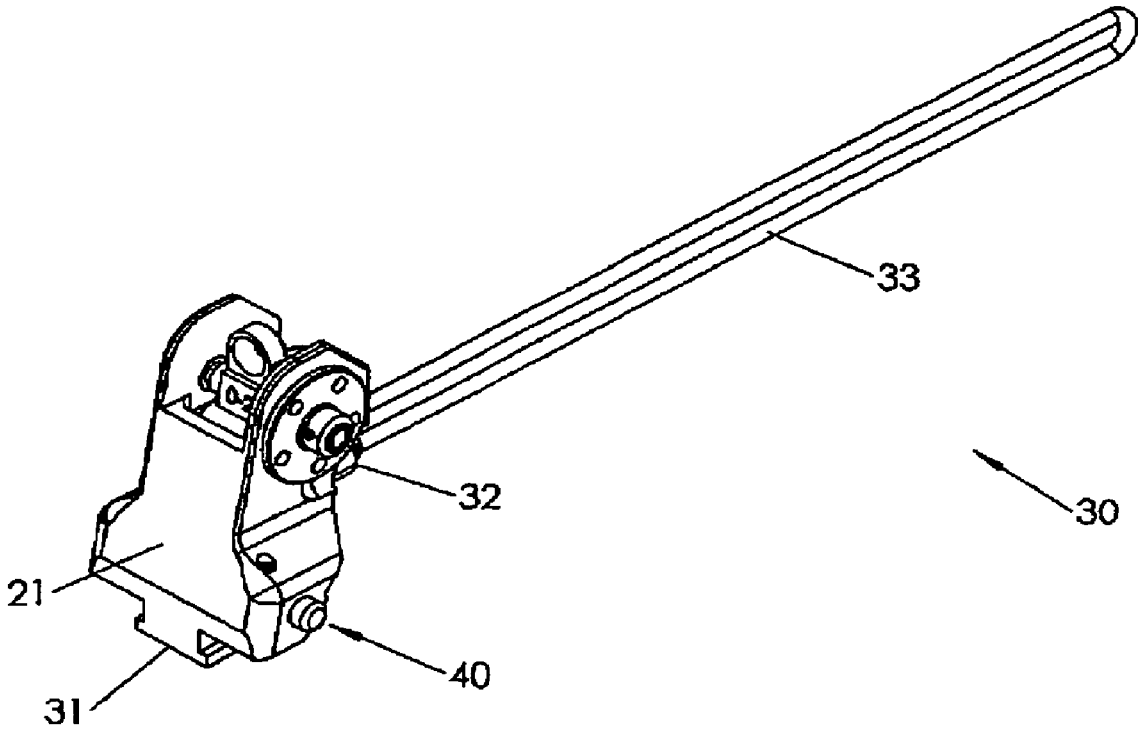
FIG. 12 is a perspective view showing the guide rod with integrated sight assembly, showing sight component assembly, spring guide, and cover retention elements directly mounted to the sight base.
Figure 13:
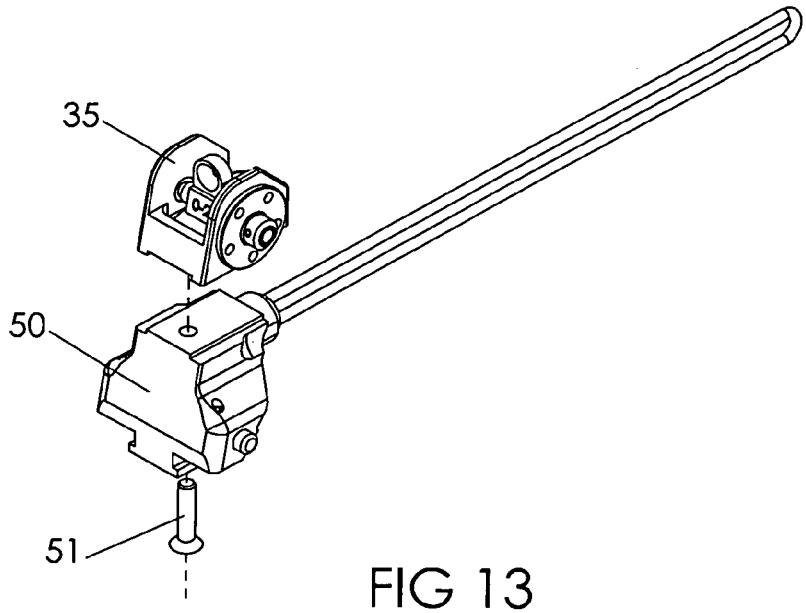
FIG. 13 is an exploded perspective view showing the guide rod with integrated sight assembly, with sight component assembly assembled as a subassembly.
Figure 14:
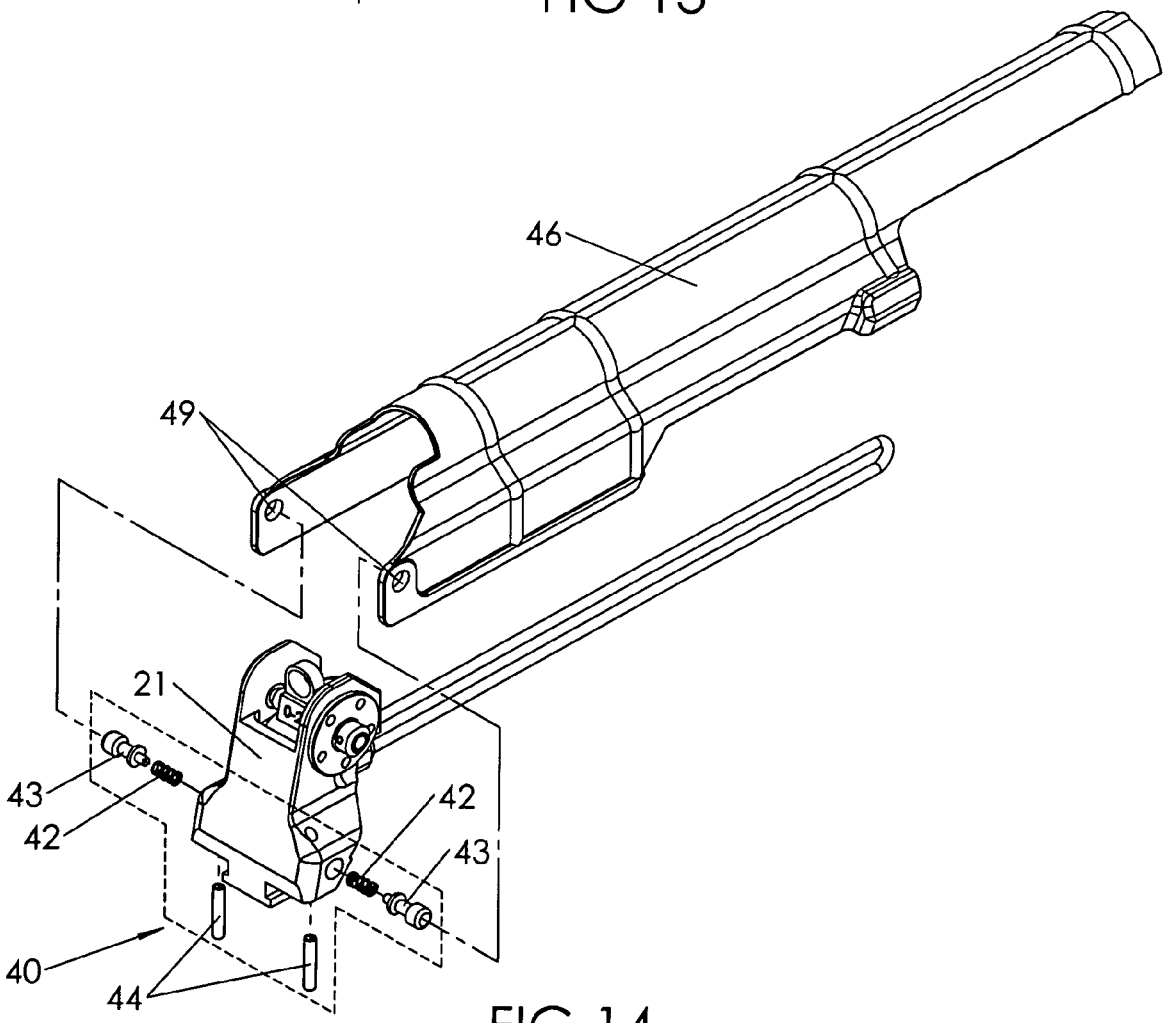
FIG. 14 is an exploded perspective view of the guide rod assembly with integrated sight, showing cover retention assembly elements exploded and their interaction with engagement holes in the receiver cover.
Figure 15:
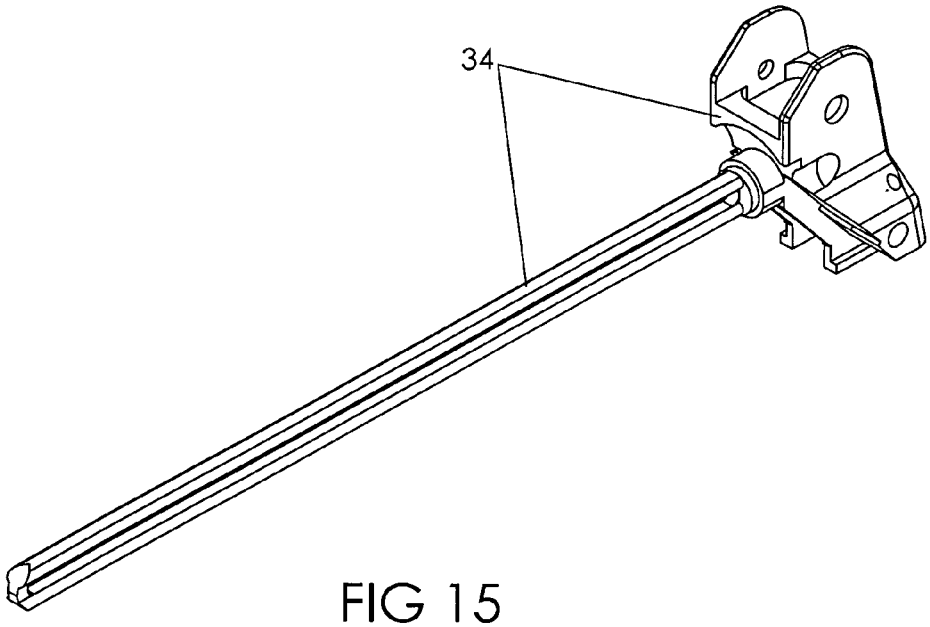
FIG. 15 is a perspective view of the sight base with an integrated spring guide.
Figure 16:
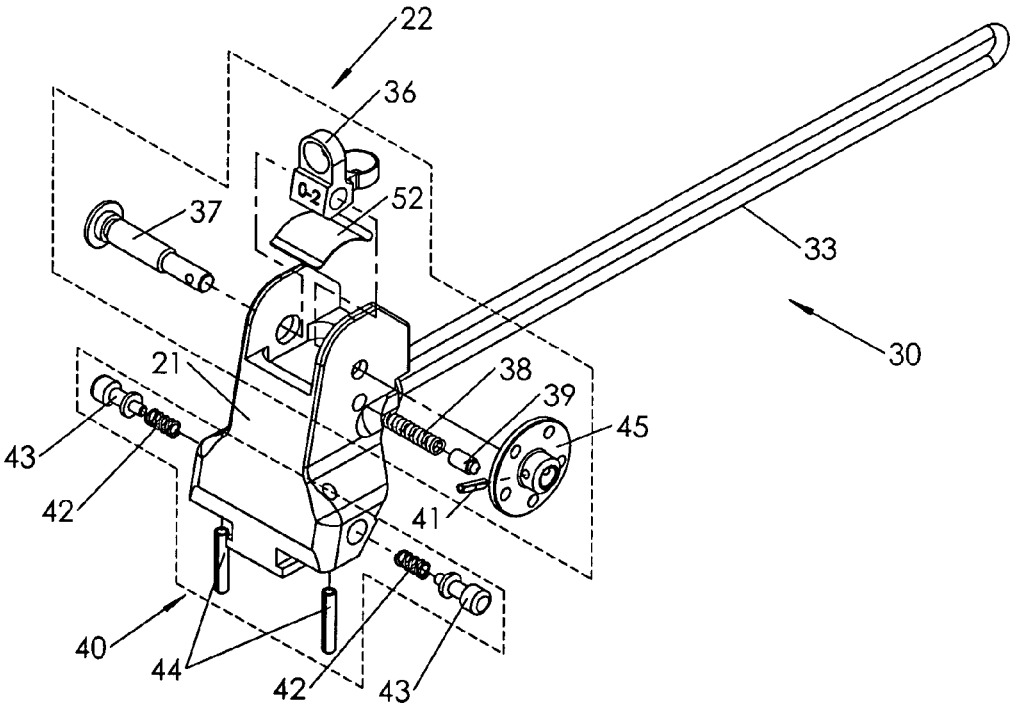
FIG. 16 is an exploded perspective view of the guide rod assembly with integrated sight.
Figure 17:
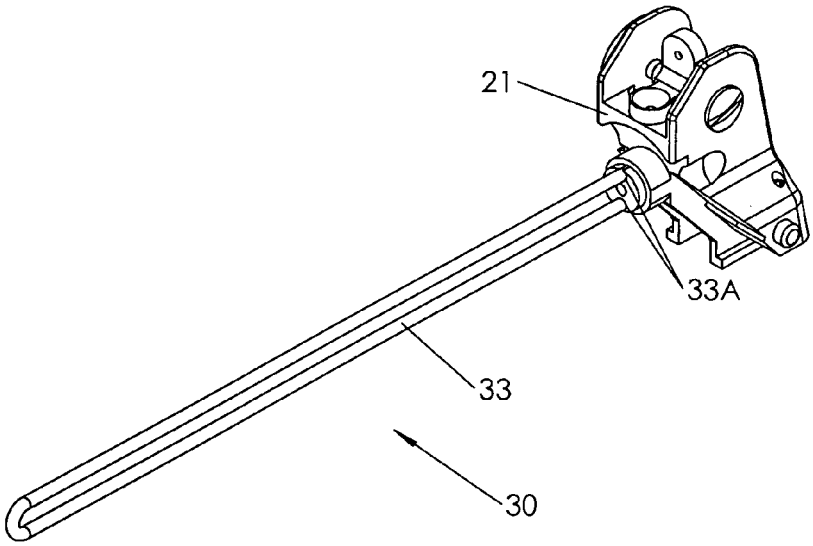
FIG. 17 is a perspective view showing the spring guide feature mounted into the mating holes machined or cast into the sight base.
Figure 18:
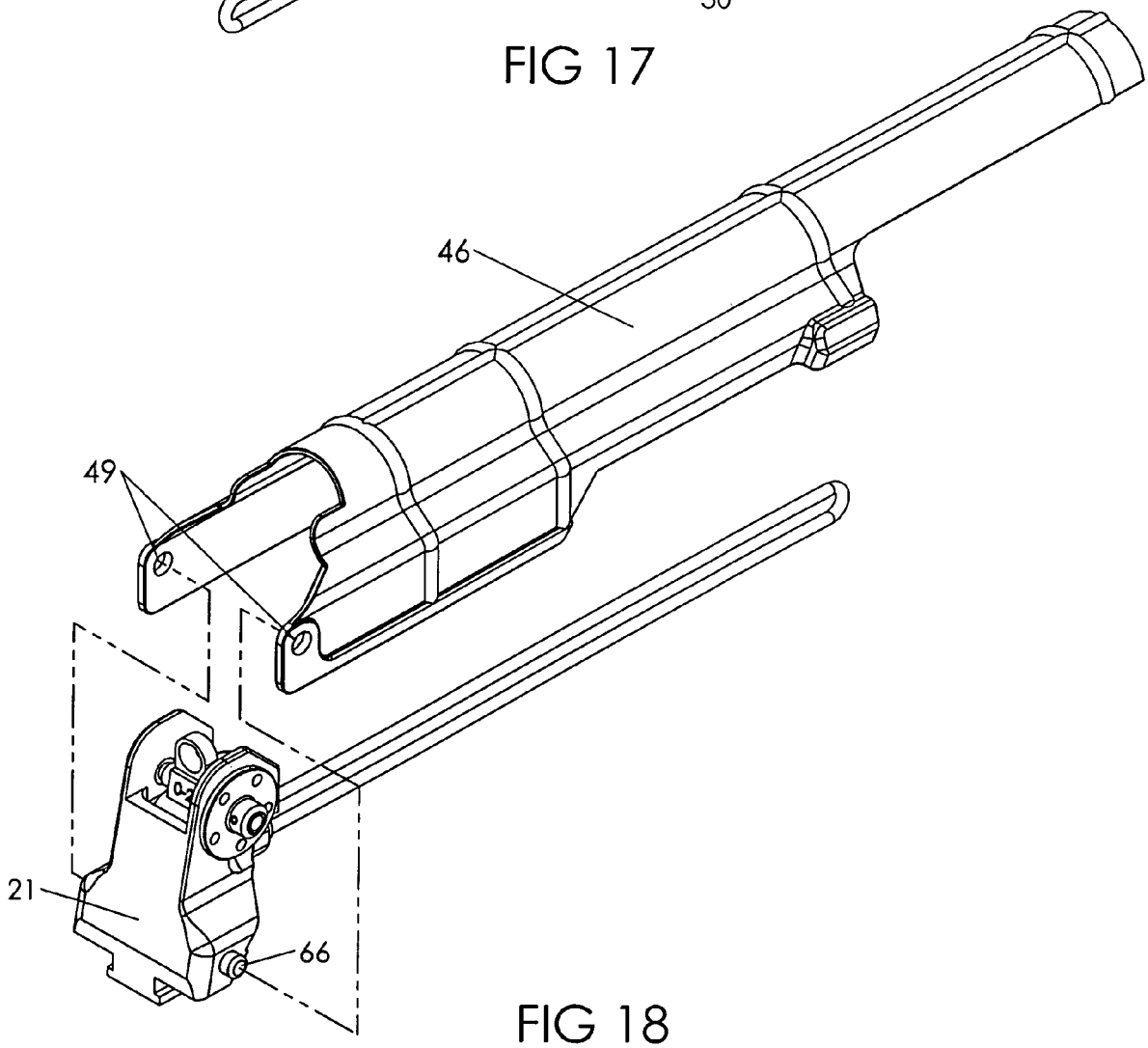
FIG. 18 is a perspective view showing cover retention elements as formed raised bosses integrated into the sight base and their interaction with engagement holes in the receiver cover.

The present invention is a rear gun sight device 30 as shown in FIG. 16 for the AK47 or similar rifle 60 as depicted in FIG. 4, which is comprised of the following elements: a sight base 21 with integrated tee shaped base 31 as depicted in FIG. 12, a sight component assembly 22, a spring guide 33 and receiver cover retention features 40 as shown in FIG. 16. This rear gun sight device will also be referred to as guide rod with integrated sight 30 in this detailed description of the preferred embodiments. The guide rod with integrated sight assembly 30 is made up of the following elements: a sight base 21, that can be fabricated by various means, such as but not limited to casting, forging or machining; but casting is preferable. The sight base 21 can be made of various materials, such as but not limited to steel, aluminum, or polymeric compounds; steel is preferable, and is designed to replace the AK47's guide rod base 24 of the guide rod 23 in the recoil assembly 25, as shown in FIGS. 8, 11 & 12. To accomplish this, the sight base 21 is provided with a tee shaped base 31, as depicted in FIG. 12, duplicating the machined base of the AK47's original guide rod base, as depicted in FIG. 11, that engages a tee shaped slot 47, shown in FIGS. 1-3 & 4-6, cut into the top rear trunion of the AK47's receiver. The sight base will also provide a recoil spring boss 32, allowing it to receive the end of the recoil spring 26 as shown in FIGS. 7-12. The sight base also provides for a spring guide 33 depicted in FIGS. 11 & 12. This spring guide 33 may be fabricated from material, such as but not limited to round stock, and material, such as but not limited to steel, aluminum or polymeric, steel is preferable, and attached to the sight base 21 as shown in FIGS. 11 & 12 by various means, such as but not limited to inserting the spring guide 33 into mating holes 33A machined or cast into the sight base 21, and secured by various means, such as but not limited to assembly locking compounds, epoxies or friction as depicted in FIG. 17, or the spring guide may be integrated into the sight base itself by molding, machining or casting as one piece 34 as depicted in FIG. 15. Integrating the tee shaped base 31, a spring boss 32 and a spring guide 33 features into the sight base 21 insures that the guide rod with integrated sight 30 will function the same as the original guide rod 23 when assembled in the AK47's recoil assembly 29 as shown in FIGS. 7, 8, 9 & 10. The sight base 21 is provided with additional features, such as but not limited to holes and relief cuts to allow for a sight component assembly 22 to include windage and elevation adjustment components, such as but not limited to screws 37, compression springs 38, leaf springs 52, spring pins 41, detent plungers 39 and detent drum 45; and aperture sight components 36 as depicted in FIG. 16. It should be noted that the components mentioned in the sight component assembly may be directly mounted to the sight base 21 as shown in FIG. 16 or assembled as a subassembly 35 and mounted to the sight base 50 by various means such as but not limited to screws 51, clamping or friction as shown in FIG. 13. Mounting the sight assembly components directly to the sight base 21 is preferable. It shall be noted that the sight base 21 will be provided features such as but not limited to holes, indentations or formed raised bosses 66 as depicted in FIG. 18 to provide for receiver cover retention elements. Yet another method is to provide holes in the sight base to mount the cover retention elements 40 consisting of compression springs 42, cover engaging detent pins 43 and spring pins 44 as depicted in FIG. 14. The cover retention elements attached to the sight base, allow holes 49 in the receiver cover 46 to engage these retention elements 40, securing the receiver cover 46 to the AK47 rifle 60 as shown in FIGS. 1-3 & 14. The cover is designed to work with the cover retention elements 40 provided on the sight base 21. The design using engagement holes 49 previously described and shown in FIG. 14, is the preferred method. This receiver cover 46 replaces the original AK47 receiver cover 48 designed to function with the original guide rod 23 as depicted in FIGS. 4-6. This rear gun sight device referred to as guide rod with integrated sight 30 when integrated into the AK47 rifle's operating system increases the sight radius by approximately eight inches over the original tangent sight 65 as depicted in FIG. 5.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A rear gun sight device for a rifle having a receiver and cover, said receiver having a tee shaped slot on the top rear trunion of the rifle's receiver, said slot designed to accept and retain a recoil assembly said rear gun sight device comprising:

a sight base having a tee shaped base to engage said tee shaped slot on the top rear trunion of the rifle's receiver and having a spring boss to accept the end of a recoil spring assembled in the recoil assembly, a spring guide to guide said recoil spring, a sight component assembly integrated with said sight base, said sight component assembly comprised of windage and elevation adjustment components as well as sight elements, and cover retention elements covering said sight component assembly.

2. The rear gun sight device as defined in claim 1 wherein the spring guide is fabricated from, but not limited to round steel stock and attached to mating holes in the sight base.

3. The rear gun sight device as defined in claim 2 wherein the spring guide is attached to the sight base with assembly locking compounds.

4. The rear gun sight device as defined in claim 2 wherein the spring guide is attached to the sight base by friction.

5. The rear gun sight device as defined in claim 2 wherein the spring guide is attached to the sight base with epoxies.

6. The rear gun sight device as defined in claim 1 wherein the spring guide is integrated into the sight base, making it one piece with the sight base.

7. The rear gun sight device as defined in claim 1 wherein the sight component assembly comprised of windage and elevation adjustment components as well as sight elements are assembled directly to holes and relief cuts integral to the sight base.

8. The rear gun sight device as defined in claim 1 wherein the sight component assembly comprised of windage and elevation adjustment components as well as sight elements are assembled as a subassembly and mounted to the sight base by screws, clamping or friction.

9. The rear gun sight device as defined in claim 1 wherein the cover retention elements are comprised of fixed raised bosses integral to the sight base that engage the matching holes or recesses in the receiver cover.

10. The rear gun sight device as defined in claim 1 wherein the cover retention elements are comprised of compression springs, cover engaging detent pins and spring pins assembled to holes in the sight base that engage the matching holes in the receiver cover.

11. The rear gun sight device as defined in claim 1 wherein the sight base is fabricated from steel alloy.

12. The rear gun sight device as defined in claim 1 wherein the sight base is fabricated from aluminum alloy.

13. The rear gun sight device as defined in claim 1 wherein the sight base is fabricated from polymeric compounds.

* * * * *